US008834072B1

(12) United States Patent
Donald

(10) Patent No.: US 8,834,072 B1
(45) Date of Patent: Sep. 16, 2014

(54) METHOD FOR FORMING SUSPENDED FOUNDATIONS

(76) Inventor: William T Donald, Bridgeport, TX (US)

( * ) Notice: Subject to any disclaimer, the term of this patent is extended or adjusted under 35 U.S.C. 154(b) by 0 days.

(21) Appl. No.: 13/358,680

(22) Filed: Jan. 26, 2012

(51) Int. Cl.
*E02D 35/00* (2006.01)

(52) U.S. Cl.
USPC ..... 405/233; 405/232; 405/256; 52/742.13; 52/126.5; 52/741.15

(58) Field of Classification Search
USPC ..... 52/742.1, 742.13, 742.14, 319, 320, 52/322, 324, 326, 126.1, 126.5–126.7, 52/296, 297, 741.11, 741.15; 405/229, 405/231, 232, 233, 256, 257
See application file for complete search history.

(56) References Cited

U.S. PATENT DOCUMENTS

| | | | | |
|---|---|---|---|---|
| 5,623,792 | A * | 4/1997 | Crumpacker | 52/126.7 |
| 5,699,643 | A * | 12/1997 | Kinard | 52/742.14 |
| 5,934,036 | A * | 8/1999 | Gallagher, Jr. | 52/323 |
| 6,076,320 | A * | 6/2000 | Butler | 52/294 |
| 6,343,894 | B1 * | 2/2002 | Fearn | 405/233 |
| 6,923,599 | B2 * | 8/2005 | Kelso | 405/230 |
| 7,707,797 | B2 * | 5/2010 | Henderson | 52/745.17 |
| 7,823,341 | B2 | 11/2010 | Kelly et al. | |
| 8,573,892 | B2 * | 11/2013 | Wissmann et al. | 405/248 |
| 2002/0148174 | A1 * | 10/2002 | Sumner, Sr. | 52/146 |
| 2003/0131544 | A1 * | 7/2003 | Miller | 52/169.1 |
| 2007/0028557 | A1 * | 2/2007 | Kelly et al. | 52/741.15 |
| 2008/0292410 | A1 * | 11/2008 | Brown | 405/231 |
| 2010/0011698 | A1 * | 1/2010 | Fearn | 52/742.14 |
| 2010/0326007 | A1 * | 12/2010 | Silber | 52/741.4 |
| 2010/0326481 | A1 * | 12/2010 | Buckner | 134/166 C |
| 2011/0120036 | A1 * | 5/2011 | Wignall et al. | 52/294 |
| 2012/0151871 | A1 * | 6/2012 | Fehr et al. | 52/741.14 |
| 2012/0216476 | A1 * | 8/2012 | Naidoo | 52/309.4 |

* cited by examiner

*Primary Examiner* — William Gilbert
*Assistant Examiner* — Alp Akbasli
(74) *Attorney, Agent, or Firm* — Mark W Handley

(57) ABSTRACT

A suspended slab (14) is spaced apart from a surface of the ground (18) by a void space (20). Structural supports (16) are provided to extend upward from the ground (18). Removable supports (22) are placed on top of the ground (18) and extend upward to a desired height. The suspended slab (14) is poured on top of the removable support (22), suspended at least in part by the plurality of structural supports (16). The removable material (22) is removed after the material of the suspended slab (14) sets, leaving the suspended slab (14) suspended by the structural supports (16) with a void space (20) of the desired height extending between the bottom of the slab (14) and a top side of the ground (18). An enclosure skirt (26) is placed around a perimeter of the suspended slab (14) to enclosed the void space (20).

20 Claims, 5 Drawing Sheets

METHOD FOR FORMING SUSPENDED FOUNDATIONS

TECHNICAL FIELD OF THE INVENTION

The present invention relates in general to foundations, and in particular to structurally suspended, poured slabs for foundations.

BACKGROUND OF THE INVENTION

Structural foundations for residential and light commercial construction are typically designed as either "slab-on-grade" or as "structurally suspended slabs." Slab-on-grade foundations are constructed and supported directly on the ground, which although being cost effective are also heavily dependent on soil strength and soil stability. Slab-on-grade foundations are also very maintenance intensive and, due to a variety of issues, have historically resulted in a significant amount of litigation arising from foundation failure due to soil movement. Suspended slabs, on the other hand, are suspended above the ground and do not sit directly on the ground, such that suspended slabs are isolated from soil movement. Although prior art suspended slabs typically are more reliable than slab-on-grade foundations, they are typically much more costly than slab-on-grade foundations. Some prior art suspended slabs have been formed similar to slab-on-grade foundations by use of void boxes which are placed on top of the soil to create a void space between the foundation and the soil, and then the void boxes are left in place beneath a poured foundation. Another technique for providing a suspended slab is disclosed in U.S. Pat. No. 7,823,341, issued to Kelly et al., which is hereby incorporated by reference as if fully set forth herein. A slab-on-grade foundation is first formed on the ground and then lifted to provide a void spaced between the foundation slab and the ground surface. The foundation slab is first poured directly on the ground with embedded lifting devices, and then after setting the slab is lifted into a fixed position above the ground surface to isolate the foundations from soil movement. Techniques for lifting on-grade slabs to provide suspended foundations are more labor intensive and require specialized components which add significantly to costs for construction materials and labor.

SUMMARY OF THE INVENTION

A suspended slab is provided spaced apart from a ground surface by a void using evacuation rather than lifting. Structural supports are provided extending upward from the ground surface to a desired height. A temporary removable material is placed on top of the ground and extend upward to the desired height. A concrete slab is placed on top of the temporary removable material, suspended at least in part by the plurality of structural supports and the temporary material. After hardening of the concrete, the temporary removable material is removed, leaving a suspended slab suspended by the structural supports with a void of the designed height extending between the bottom of the slab and the ground. In one embodiment the temporary removable material is provided by a combination of a number of rigid forms and a loose particulate material, such as sand. The rigid forms for first placed directly on the ground and then covered with several inches of a loose particulate material, such as sand, and then the particular material is covered with a liner to prevent foundation slab materials from absorbing into the particulate material. The foundation slab will be poured on top of the loose particulate material and then, after the slab sets, the loose particulate material will be jetted from between the foundation slab and the rigid forms. Removal of the loose particulate material provides a clearance spacing allowing for removable of the rigid forms from beneath the foundation. A skirt is preferably placed around the perimeter of the slab to enclosed the peripheral edge of the void.

According to the method of the present invention for forming a new foundation, a flat slab is formed on a fluid, temporary, removable material or collapsible equipment so that the slab will rest on structural supports set at the same height of the removable material. Various styles of structures may be used for the structural support bases, including but not limited to concrete piers, helicals, metal shafts (pilings), spread footings, micro piles, and rock. Various temporary, fluid, removable materials or collapsible equipment and various methods of removing the material or equipment will result in leaving the cured concrete slab resting on the structural supports with a void between the bottom of the slab and the ground. The type of the removable material or collapsible equipment will give cause to the removal method. Removal method can be by vacuum, jetted fluids, mechanical auger system, mechanical retrieval, releasing of pressurized bulkheads or chemical dissolving. This provides an economical concrete slab foundation that can be installed on top of structural supports and temporary removable materials or equipment and then the material or equipment removed, leaving a certain void space between the slab and the earth.

DESCRIPTION OF THE DRAWINGS

For a more complete understanding of the present invention and the advantages thereof, reference is now made to the following description taken in conjunction with the accompanying Drawings in which

FIG. 1 is a vertical section view of a foundation with a suspended slab being formed on a removable support according to the present invention;

FIG. 2 is a vertical section view of the foundation with the suspended slab after completion;

FIG. 3 is a top plan view of the foundation having the suspended slab;

FIG. 4 is a side elevation view of natural loose fill material used for providing a temporary support for forming the slab according to the present invention;

FIG. 5 is a side elevation view of synthetic loose fill material used for providing a temporary support for forming the slab according to the present invention;

FIG. 6 is a perspective view of an expanded polystyrene block used for providing a temporary support for forming the slab according to the present invention;

FIG. 7 is a side elevation view of a hydraulic or pneumatic jack for providing a temporary support for forming the slab according to the present invention;

FIG. 8 is a side elevation view of an inflatable bladder used for providing a temporary support for forming the slab according to the present invention;

FIG. 9 is a perspective view of a rigid platform used for providing a temporary support for forming the slab according to the present invention;

FIG. 10 is a vertical section view of a foundation being formed using a hybrid removable support according to the present invention;

FIG. 11 is a vertical section view of a foundation being formed using a soluble fill material as a removable support according to the present invention;

FIG. 12 is a vertical section view of a portion of a foundation being formed using an inflatable bladder and a removable platform support according to the present invention; and FIG. 13 is a vertical section view of a portion of a foundation being formed using a hydraulic jack, or a pneumatic jack, and a removable platform support according to the present invention.

DETAILED DESCRIPTION OF THE INVENTION

Figure 1:
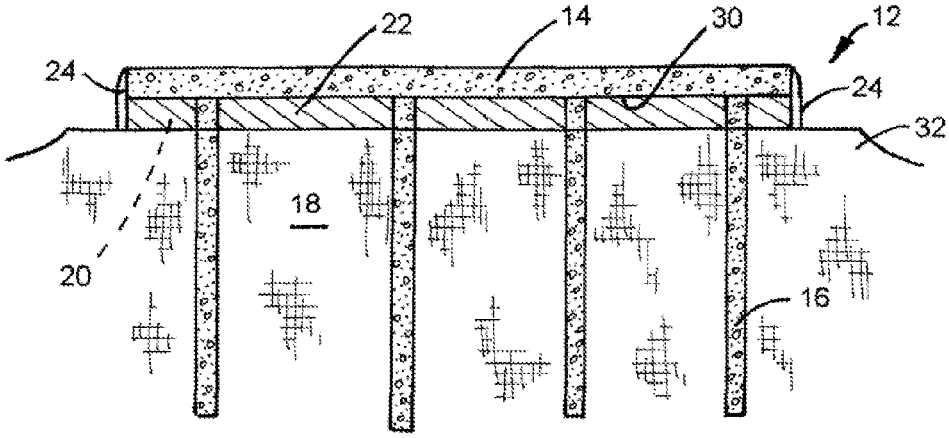
FIGS. 1-13 show various aspects of a method for forming suspended slabs for foundations according to the present invention, as set forth below.

FIG. 1 is a vertical section view of a foundation 12 having a suspended slab 14 mounted on top of structural supports 16. The structural supports 16 are shown as being provided by concrete piers. Removable supports 22 are disposed in a void space 20 beneath the slab 14 and above the ground 18. A pad site 32 may be created by several methods with the final grade elevation determined by the desired final elevation of the slab after it is poured into place. In forming the foundation 12, the structural supports 16 are installed, and may be of various forms well known in the industry. Plumbing and electrical conduit risers will be set in place to extend from the ground 18 upward above where the top of the slab 14 will be located. Then, the removable supports 22 will be placed on the ground 18 with edge retainers 24, such as form boards, provided to extend upward from the peripheral edge of the removable supports 22. A liner 30 will preferably be placed on top of the removable supports 22 to prevent concrete typically used for forming the slab 14 from moving into and between the removable supports 22. The edge retainers 24 preferably extend to a height at which the top of the slab 14 will be disposed. The slab 14 will then be poured on top of the liner 30 and the removable supports 22, and atop the structural supports 22. After the slab 14 cures and sets such that it will be self-supporting atop of the structural supports 16. The edge retainers 24 are removed, then the removable supports 22 are removed from beneath the slab 14 to provide a void space 20 between the ground and the underside of the slab 14. This serves to isolate the slab 14 from soil movement in the ground 18.

Figure 2:
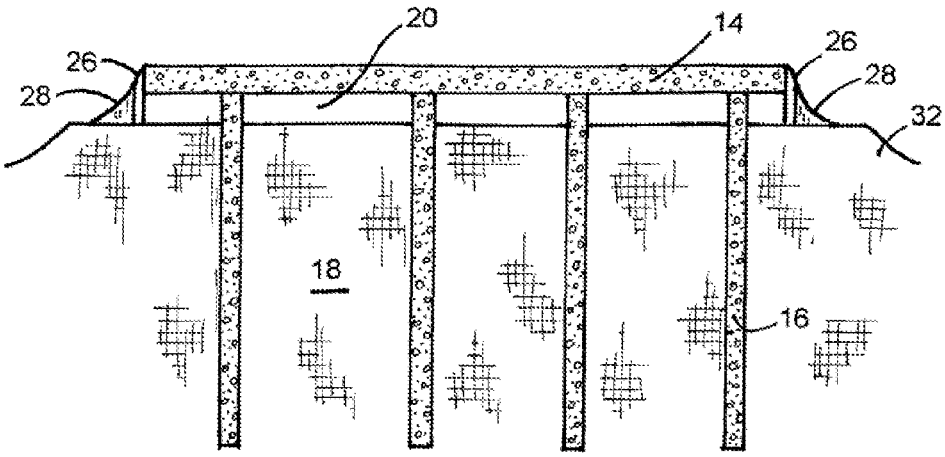

FIG. 2 is a vertical section view of the foundation 12 with the suspended slab 14 after the slab 14 has cured such that it is self-supporting and the removable supports 24 have been removed. A void space 20 is not disposed between the underside of the slab 14 and the upper surface of the ground 18. The liner 30 may be removed from beneath the slab 14, or optionally it may be left in place. The liner 30 is preferably provided by polyethylene sheeting or polypropylene planking, often depending upon the type of fill materials used for the removable supports 22. In some embodiments plywood may be used, preferably covered by polyethylene sheeting. The concrete typically poured to form the slab 14 will typically stick to the polyethylene sheeting and the polypropylene planks, which will preferably be left in place rather than recovered. A liner 30 may not be required when loose sand is used for the fill material. The edge retainers 24 have been removed and replaced with an enclosure skirt 26, and then fill material such as dirt is placed against the outer side of the enclosure skirt 26.

Figure 3:
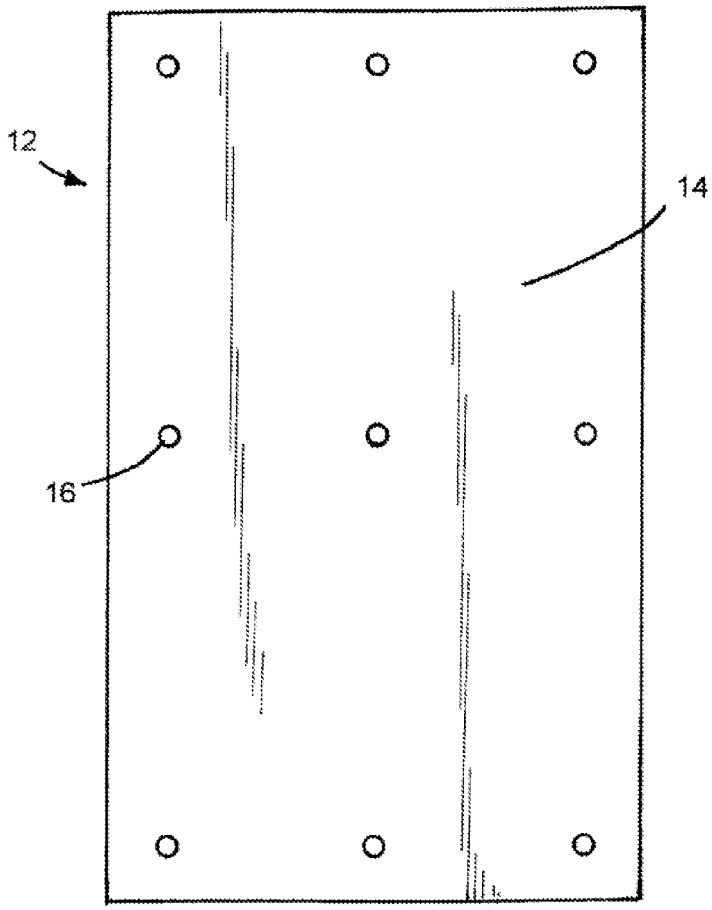

FIG. 3 is a top plan view of the foundation 12 having the suspended slab 14. The structural supports 10 are shown spaced apart around the slab 14 in conventional fashion. The structural supports 16 are installed into the ground 18 at spaced-apart locations. The layout and spacing of the structural supports 16 may be determined according to the design of the structural concrete slab, among other design parameters. Various types of structural supports 16 may be used, including various types of piers, pilings and spread footings. The top of each structural support 16 will be located above ground level 18, usually at the same elevation throughout the slab 14. The elevation of the structural supports 16 will preferably be determined according to the desired height for the void space 20 and the desired elevation for the finished slab 14. Before the concrete for the slab 14 is poured, perimeter edge retainers 24 provided by form boards are set in place around the region where the slab 14 to be formed. Piping for sewer drainage and water supply may be installed before the concrete is poured to form the slab 14. The permanent plumbing risers are preferably shielded with oversized sleeves preventing contact between the slab 14 and the plumbing risers. Any electrical conduits may also have "leave outs." With the edge retainers 24 located in place, and the removable support 22 disposed inside the edge retainers 24. The liner 30 is preferably placed over and covers the material providing the removable supports 22. When the removable support material 22 is in place, any post-tension cables, steel, or other concrete reinforcing materials within the design can now be put in place. Then the concrete is poured and cast into the slab 14. The removable material providing the removable supports 22 will be removed once the slab 14 is cured.

Figure 6:
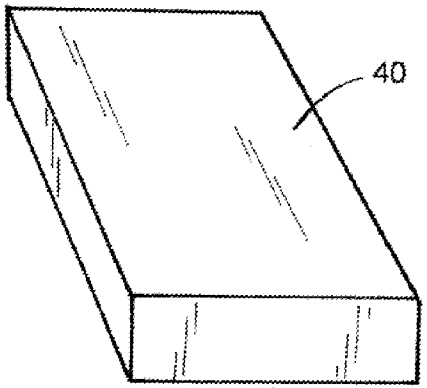
Figure 5:
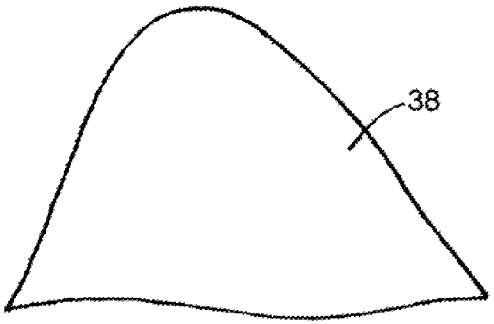
Figure 4:
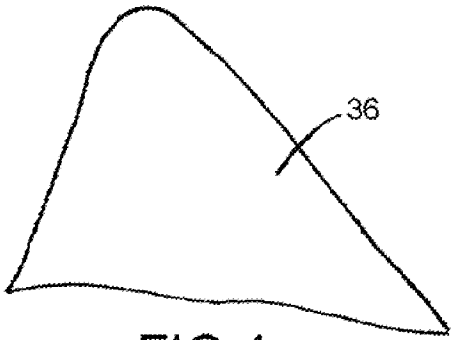

FIGS. 4-9 are various views of fill material which may be used to provide the removable supports 22. FIG. 4 is a side elevation view of natural loose fill material 36 used for providing the removable support 22 for the slab 14. The loose fill material 36 may be naturally occurring materials, such as sand, dirt, mulch, sawdust, and the like. FIG. 5 is a side elevation view of other loose fill materials 38 which may be formed of synthetic materials to provide the removable support 22, such as ground plastic, rubber, and the like. FIG. 6 is a perspective view of an expanded polystyrene block 40 which may be used to provide the removable supports 22. Preferably any of these materials may be used multiple times.

Figure 9:
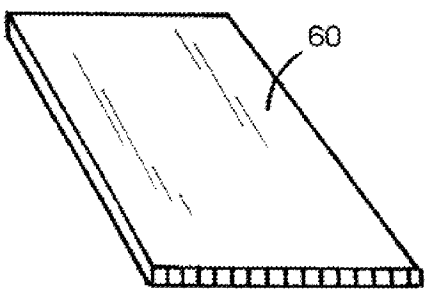
Figure 8:
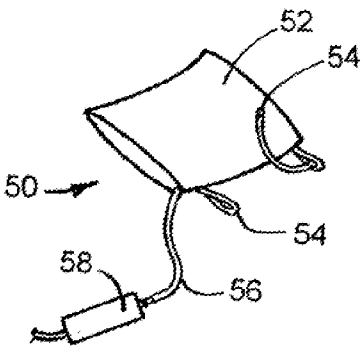
Figure 7:
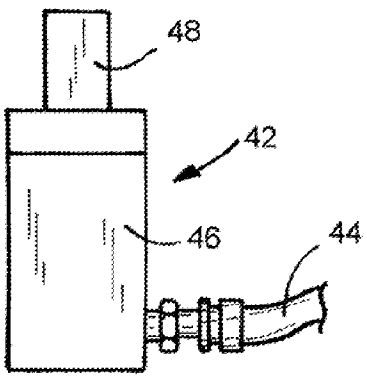

FIG. 7 is a side elevation view of a hydraulic or pneumatic jack 42 which may be used in conjunction with the platform support 60 of FIG. 9 to provide the removable support 22 for forming the slab 14 atop the structural supports 16. The hydraulic 42 is preferably a conventional hydraulic or pneumatic jack jack having a hose 44 connecting to a valve, pump and power unit (not shown), a cylinder 46 and a piston 48. FIG. 8 is a side elevation view of an inflatable bladder 50 for use with the platform support 60 of FIG. 9 to provide the removable support 22 for forming the slab 14 atop the structural supports 16. The inflatable bladder 50 preferably has a bladder 52 provided by an air bag, a supply hose 56 and a valve 58. Tie loops 52 are providing for securing to a retrieval means such as cables or lines, such that the inflatable bladder 50 may be removed from beneath the slab 14 once the concrete for the slab 14 has cured. FIG. 9 is a perspective view of a rigid platform 60 used for providing a temporary support for forming the slab 14. The rigid platform 60 is preferably formed of polypropylene sheeting, but other materials may be used.

Figure 10:
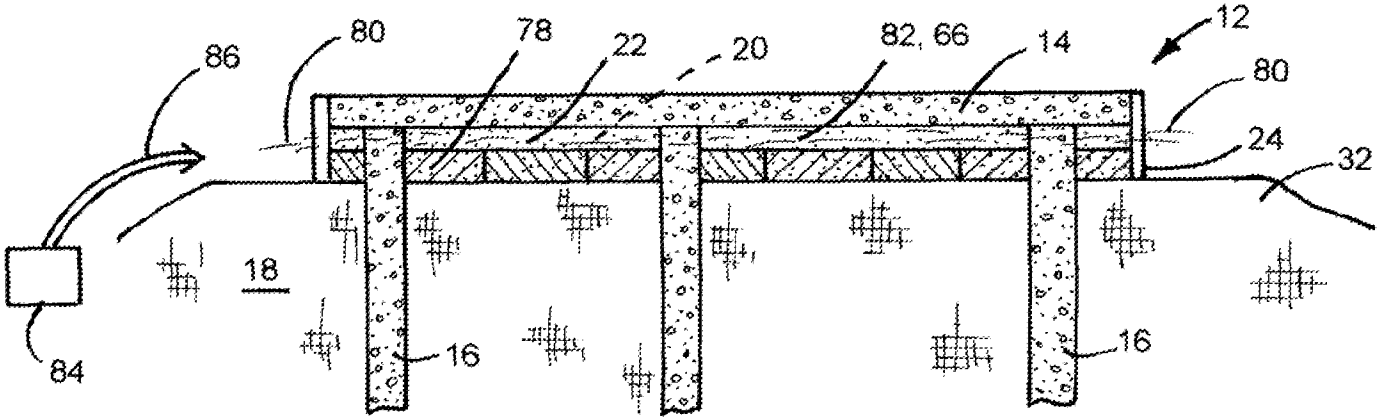

FIG. 10 is a vertical section view of a foundation 12 being formed by means of the removable support 22 using a hybrid removable support provided by a combination of removable support blocks 78 and loose fill material 82. Preferably, polystyrene blocks 40 (shown in FIG. 6) are used for the support blocks 78, and loose sand 36 (shown in FIG. 4) is used for the loose fill material 82. The loose sand is jetted from place with water or air, or a combination thereof. A liner 30 is not required when loose sand is used for the loose fill material 82, but may optionally be used. The loose fill material 82 may also include soluble fill materials 66, or a combination of soluble fill material 66 and loose fill material 82. The loose fill material 82 may be provided by the materials 36 and 38 discussed above in reference to FIGS. 4 and 5. The removable support blocks 78 may be provided by the expanded polystyrene blocks 40 of FIG. 6, or other suitable materials, such as wood blocks or metal blocks. Retrieval lines 80 are provided for removing the removable support blocks 78 after the slab 14 has sufficiently cured. The loose fill material 82 is preferably sand, but may be other removable loose fill material in other embodiments. In some embodiments the fill material 82 may be provided by soluble material, such as the soluble fill material 66 noted below. The expanded polystyrene blocks 40 are also soluble using gasoline and other hydrocarbons as a solvent, but preferably will be retrieved rather than dissolved when used for the removable support blocks 78. Preferably a power unit 84 with a hose 86 is used to remove the loose fill material 82, or the soluble fill material 66 if used in place of the loose fill material 82, and then the support blocks 78 may be removed by use of the retrieval lines 80. This arrangement provides for reusable support blocks 78 and loose fill material 82 or soluble fill material 66. The loose fill material 82 and the soluble fill material 66 may be expendable or may be recovered. The thickness of the loose fill material 82 may be several inches, just enough to provide clearance for removal of the removable support blocks 78 from between the foundation slab 14 and the ground 18. The support blocks 78 are removed from beneath the slab 14 and may be reused for later forming other foundation slabs 14.

Figure 11:
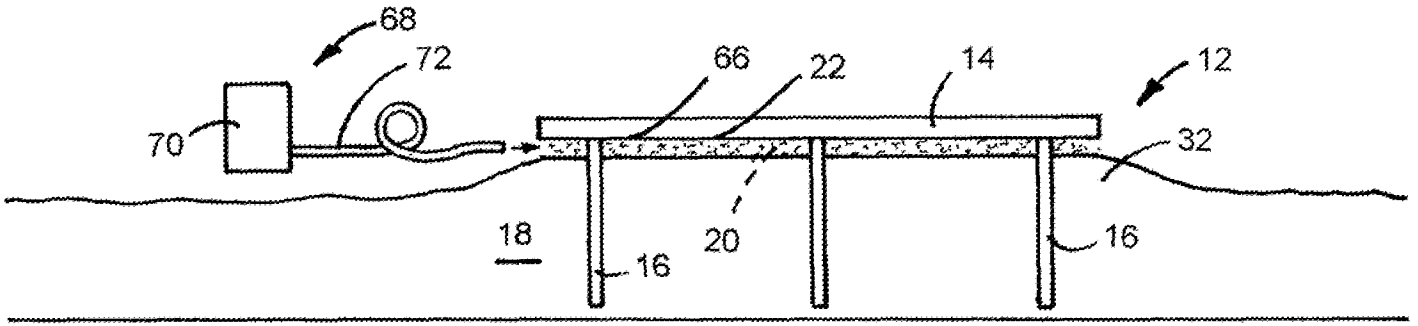

FIG. 11 is a vertical section view of a foundation being formed using a soluble fill material 66 as a removable support 22. The soluble fill material 66 is placed on top of the ground 18 and shaped for pouring the slab 14 atop the soluble fill material 66. The slab 14 is poured and cured. Then, a solvent application unit 68 has a supply unit 70 which passes a solvent through a supply hose 72. The solvent is applied to the soluble fill material 66 which is dissolved leaving the void space 20 between the slap 14 and the ground 18. In some embodiments, the soluble fill material 66 may be recovered for later use, and in other embodiments the soluble fill material 66 may be expendable. In some embodiments water soluble materials may be used for the soluble fill material 66 and water used for the solvent. In other embodiments a chemical solvent may be used. FIG. 11 also serves to illustrate an embodiment of loose fill materials 36, 38 (not shown) being used in place of the soluble fill material 66, and then being jetted out by air or another fluid stream, such as water. Examples of loose fill materials are the materials set forth in reference to FIGS. 4 and 5 above. Additionally, a combination of loose fill materials 36, 38 (not shown) and soluble fill materials 66 may be used. In some embodiments, expanded polystyrene may be used for the soluble fill material 66, either formed as blocks, loosed beads or planks. Polystyrene may be dissolved by use of gasoline and other hydrocarbon based solvents.

Figure 12:
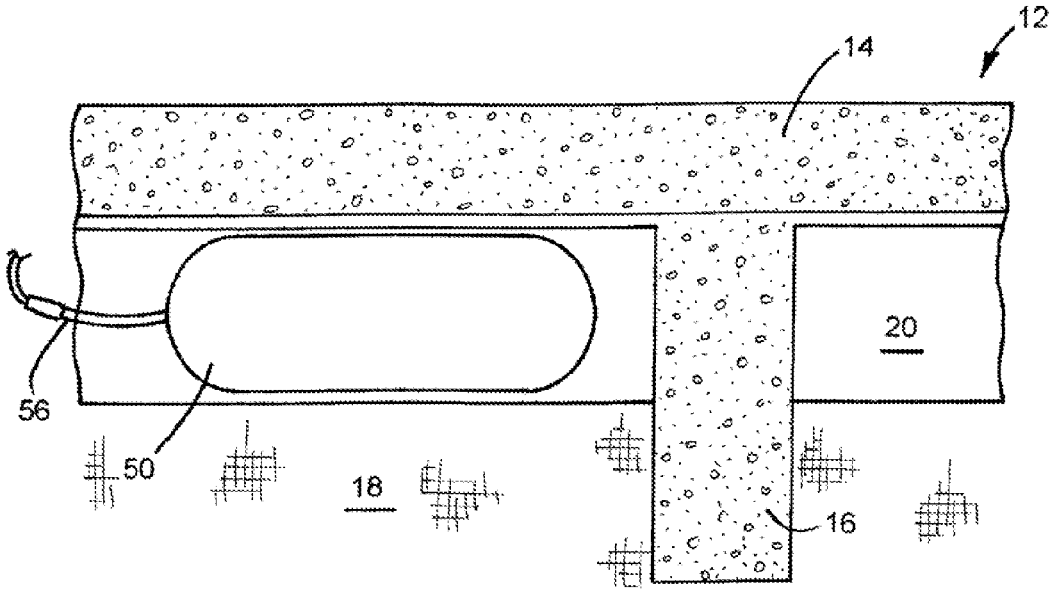

FIG. 12 is a vertical section view of a portion of the foundation 12 being formed using a plurality of inflatable bladders 50 (one shown) located beneath the platform support 60. A supply hose 56 and valve 58 control injection of fluid, such as air, into and out of the inflatable bladder 50. The removable platform 60 is supported by the inflatable bladder 50 until the slab 14 is sufficiently cured, and then the inflatable bladder 50 may be removed. The platform support 60 may be left in place, or in other embodiments may be removed from beneath the slab 14.

Figure 13:
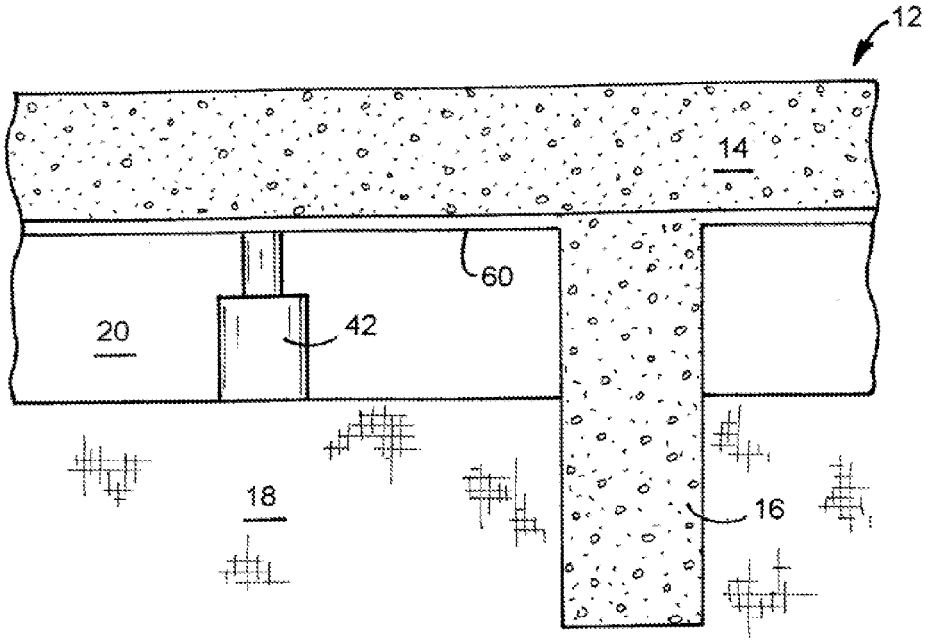

FIG. 13 is a vertical section view of a portion of the foundation 12 being formed on top of a removable support 22 provided by a hydraulic jacks 42 (one shown) and the removable platform 60. The jack 42 may also be provided by a pneumatic jack or an air jack. A supply hose 44 is connected to the hydraulic jack 42, and the jack 42 supports the removable platform 60. After the removable platform 60 is disposed at a desired height, the slab 14 may be poured as noted above for FIG. 1. After the slab 14 cures, the hydraulic jack 42 is removed. The platform support 60 may be left in place, or in other embodiments may be removed from beneath the slab 14.

The slab 14 thickness can vary depending upon loads spans, and strength of concrete and as determined by the design. The thickness of the slab 14 allows the cables to be placed utilizing an established engineering principle of "profiling cables." This principle allows the cables to exert a net uplift onto the slab system along the tendon path in addition to the pre-compression that the tendons impart to the slab 14 at the slab edges. Alternatively, the slab 14 may comprise other conventionally reinforced concrete methods.

Once the poured concrete reaches an adequate cured condition, the form boards providing the edge retainers 24 are removed and a upon the structural process of removing the chosen temporary removable material or equipment begins. This removal of the temporary removable material 22 leaves the slab 14 suspended above the ground 18, resting upon the supports 16 and leaving the desired void space 20 between the bottom of the slab 14 to the top of ground 18. The amount of void 20 under the slab can be determined from soils data and reports and is specified in the designs.

As described above, an elevated structural slab 14 is constructed, permanently supported by structural supports 16 transferring the loads into the supporting soils. With this approach the potential soil forces against the slab 14 are essentially removed from the equation as the ground 18 no longer can touch or affect the slab 14. As additional benefit, additional time and expense can be saved, by eliminating the need to dig trenches for stiffener beams. The absence of trenches means fewer delays due to rain and/or snow. Moreover much greater quality control over construction tolerances, materials and labor is possible than with previous void box or slab lifting devices methods.

As will be appreciated to those of skill in the art, the embodiments described herein for forming new foundations for structures has a number of useful applications in a number of environments. The present invention provides a suspended foundation to be formed in methods similar to less expensive foundation slabs formed by slab-on-grade techniques. In this way, the construction cost for the foundation may be kept relatively low, yet the foundation will perform like more suspended foundation systems. The perimeter of the foundation slab is preferably enclosed by installing a "skirt." Evacuation rather than lifting is used according to the present invention, eliminating the need for costly lifting equipment required for pouring foundations on grade and then lifting above grade to provide a void space.

Applications and benefits for the embodiments described above include use where active soils (high PI and PVR) are encountered. Providing a foundation with a void underneath prevents movements within the foundation due to soil moving. The present invention may also be used for building foundations on low weight bearing capacity soils, with piers or footers constructed to support the foundation above the soil. The present invention may also be used to prevent the foundation from contacting corrosive soils, such as in areas with high concentrations of sulfate or other chemical compounds, and to utilize the void space as a ventilation space for remediation of gases such as radon. A slab with a void underneath provides ventilation under the foundation for remediation of gases, such as radon. A foundation with a void beneath also provide a means of isolating the foundation from frost heave induced stresses. With soils that are not compacted at the surface, the piers support all of the foundation forces, thus eliminating the need to compact the soils. The present invention may also be used to provide pier and slab foundations in locations where no geotechnical data is available or where data cannot be obtained, or where slope stability is questionable. The present invention also reduces construction time and associated expense, as well as providing for greater quality control and greater material control, and also providing significant reductions in warranty issues and the costs related to warranty insurances encountered with conventional foundations.

Although the preferred embodiment has been described in detail, it should be understood that various changes, substitutions and alterations can be made therein without departing from the spirit and scope of the invention as defined by the appended claims.

What is claimed is:

1. A method for forming a foundation suspended above a ground surface and separated from the ground surface by a void without lifting the foundation upward, the method comprising the steps of:

placing a plurality of structural supports into the ground, and extending above the ground surface to a desired height of the void;

installing temporary removable materials at the desired height for the void, and level with tops of the plurality of structural supports;

forming a slab on top of the temporary removable materials, wherein the slab extends over the tops of and is disposed on the structural supports;

then removing the temporary removable materials from beneath the slab and thereby creating the void between a bottom of the slab and the ground, with the slab supported by the structural supports and spaced apart from ground surface by the void; and installing a skirt on the perimeter of the slab to enclose a peripheral edge of the void.

2. The method of claim 1, wherein one or more of the temporary removable material is of a natural material, selected from sand, dirt, gravel, wood mulch, and sawdust; and wherein the step of removing the temporary fill materials comprises removal by vacuum.

3. The method of claim 1, wherein one or more of the temporary removable material is of a natural material, selected from sand, dirt, gravel, wood mulch, and sawdust; and wherein the step of removing the temporary fill materials comprises removal by jetted fluids.

4. The method of claim 1, wherein one or more of the temporary removable materials is of a processed material being ground plastics, ground rubber, etc. and is removed by air vacuum.

5. The method of claim 1, wherein soluble foam is placed as a temporary removable material and is removed by dissolving chemicals.

6. The method of claim 1, wherein the step of installing temporary removable materials comprises:

placing blocks on the ground around the plurality of structural supports; and placing a loose fill material atop the blocks.

7. The method of claim 6, wherein the step of then removing the temporary removable materials from beneath the slab comprises:

removing the loose fill material with jetted fluids or vacuuming the loose fill material; and then, mechanically removing the blocks.

8. The method of claim 1, wherein collapsible equipment is holding up a platform to receive the slab and is then control released to collapse and remove the equipment.

9. The method of claim 1, wherein the skirt is installed and will be held in place with grading soils.

10. The method of claim 1, wherein the skirt is installed and will be held in place with mechanical attachments.

11. A method for forming a suspended foundation which is separated from the ground surface by a void without lifting the foundation upward, the method comprising the steps of:

providing a plurality of structural supports extending from the ground surface to a desired height above the ground surface of the void;

installing removable materials from the ground surface to the desired height for the void;

forming a slab on top of the temporary removable materials, with a weight of the slab supported, at least in part, by the plurality structural supports;

after forming the slab, removing the temporary removable materials from beneath the slab and thereby creating the void between a bottom of the slab and the ground surface, with the weight of the slab supported by the structural supports and spaced apart from ground surface by the void; and installing a skirt on the perimeter of the slab to enclose a peripheral edge of the void.

12. The method of claim 11, wherein one or more of the temporary removable material is of a natural material, selected from sand, dirt, gravel, wood mulch, and sawdust; and wherein the step of removing the temporary fill materials comprises removal by vacuum.

13. The method of claim 11, wherein one or more of the temporary removable material is of a natural material, selected from sand, dirt, gravel, wood mulch, and sawdust; and wherein the step of removing the temporary fill materials comprises removal by jetted fluids.

14. The method of claim 11, wherein dissolvable foam is placed as a temporary removable material and is removed by dissolving chemicals.

15. The method of claim 11, wherein collapsible equipment is holding up a platform to receive the slab and is then control released to collapse and remove the equipment.

16. A method for forming a suspended foundation which is separated from the ground surface by a void without lifting the foundation upward, the method comprising the steps of:

providing a plurality of structural supports extending from the ground surface to a desired height above the ground surface of the void;

installing removable blocks on the ground surface around the structural supports;

placing loose fill material on the removable blocks to the desired height for the void;

forming a slab on top of the loose fill material and the removable blocks, with a weight of the slab supported, at least in part, by the plurality structural supports;

after curing the slab, removing the lose fill material from atop the removable blocks, such that the slab is supported by the structural supports;

removing the removable blocks from beneath the slab, leaving a void space between the underside of the slab and the ground surface; and installing a skirt on the perimeter of the slab to enclose a peripheral edge of the void.

17. The method of claim 16, wherein one or more of the loose fill material is of a natural material, selected from sand, dirt, gravel, wood mulch, and sawdust.

18. The method according to claim 16, wherein the loose fill material is removed by vacuum.

19. The method of claim 16, wherein the step of removing the temporary fill materials comprises removal by jetted fluids.

20. The method of claim 16, wherein the removable blocks are formed of materials selected from foam, wood or metal.

* * * * *